US008141459B2

(12) United States Patent
Myburgh

(10) Patent No.: US 8,141,459 B2
(45) Date of Patent: Mar. 27, 2012

(54) POWERED ADJUSTABLE PIPE WRENCH

(76) Inventor: Herman Myburgh, Lascassas, TN (US)

( * ) Notice: Subject to any disclaimer, the term of this patent is extended or adjusted under 35 U.S.C. 154(b) by 548 days.

(21) Appl. No.: 12/385,884

(22) Filed: Apr. 22, 2009

(65) Prior Publication Data

US 2009/0229423 A1 Sep. 17, 2009

Related U.S. Application Data

(63) Continuation-in-part of application No. 12/003,380, filed on Dec. 21, 2007, now Pat. No. 7,530,294, which is a continuation-in-part of application No. 11/907,516, filed on Oct. 12, 2007, now abandoned.

(60) Provisional application No. 60/851,281, filed on Oct. 13, 2006.

(51) Int. Cl.
*B25B 17/00* (2006.01)

(52) U.S. Cl. ..... 81/57.11; 81/57; 81/57.14; 81/57.15

(58) Field of Classification Search ..... 81/57, 57.11, 81/57.14, 57.15
See application file for complete search history.

(56) References Cited

U.S. PATENT DOCUMENTS

| | | | | |
|---|---|---|---|---|
| 2,122,760 | A | | 7/1938 | Scott et al. |
| 2,486,755 | A | | 11/1949 | Mitchell |
| 2,645,460 | A | * | 7/1953 | Lundeen ..... 81/57.2 |
| 3,308,691 | A | * | 3/1967 | Guier ..... 81/57.34 |
| 3,709,072 | A | | 1/1973 | Rogers |
| 3,988,946 | A | | 11/1976 | Gonzalez |
| 5,000,065 | A | | 3/1991 | Haynes |
| 6,253,643 | B1 | | 7/2001 | Buck |
| 6,332,377 | B1 | | 12/2001 | Pietras et al. |
| D530,166 | S | | 10/2006 | Becker et al. |
| 2003/0010160 | A1 | | 1/2003 | Dugan |
| 2004/0025642 | A1 | | 2/2004 | Hsien |

* cited by examiner

*Primary Examiner* — Lee D Wilson
*Assistant Examiner* — Shantese McDonald
(74) *Attorney, Agent, or Firm* — Richard C. Litman

(57) ABSTRACT

The powered adjustable pipe wrench has a motorized rotary grip to rotate a pipe component clamped therein and a laterally spaced stationary grip to hold a second pipe component stationary relative to the first as it is being rotated. The pipe wrench may have a cylindrical jaw housing with semicylindrical fixed and openable portions hinged to one another. One end of the housing includes a powered component to rotate the pipe component held therein, while the other housing end includes jaw components holding the second pipe component stationary. Alternatively, the pipe wrench may have a powered component extending from the jaw of the wrench body to rotate the first pipe component, and a rectilinearly adjustable jaw portion extending from the wrench body. A set of jaw components is axially spaced from the rotary component to hold the second pipe component stationary.

19 Claims, 17 Drawing Sheets

POWERED ADJUSTABLE PIPE WRENCH

CROSS-REFERENCE TO RELATED PATENT APPLICATIONS

This application is a continuation-in-part of U.S. patent application Ser. No. 12/003,380 filed on Dec. 21, 2007, now U.S. Pat. No. 7,530,294 which is a continuation-in-part of U.S. patent application Ser. No. 11/907,516 filed on Oct. 12, 2007, now abandoned which claims the benefit of U.S. Provisional Patent Application Ser. No. 60/851,281 filed on Oct. 13, 2006.

BACKGROUND OF THE INVENTION

1. Field of the Invention

The present invention relates generally to tools used in the plumbing trade, and more particularly to a powered adjustable pipe wrench for use with threaded pipe and threaded pipefittings.

2. Description of the Related Art

The current practice of attaching, tightening, loosening, and removing threaded pipe components to one another is a manual process, with two pipe wrenches normally being employed. One pipe wrench is adjusted and attached to grip the threaded first component, e.g., a pipe fitting, etc., and rotate the component in the desired direction. The second pipe wrench is adjusted and attached to grip the second component (pipe or fitting, etc.) to rotate the second component in the opposite direction, or to hold the pipe while the first wrench is used to rotate the first component, in order to thread or unthread the two components to or from one another. This process is normally performed by a person manually pushing and pulling the handles of the pipe wrenches together to compensate for torque. When a suitable fixed object is available in close proximity to the work being performed, the handle of one pipe wrench may be braced against the fixed object while the second pipe wrench handle is rotated toward or away from the first pipe wrench to perform the desired threading or unthreading of the two pipe components.

This operation often requires the exertion of significant human physical force for proper performance, and may result in injury to the person performing this function, as well as injury to helpers or bystanders. This is all the more so when this process is performed while the worker is standing on a ladder, scaffold or lift, and the pipe assembly is overhead. This operation may also be performed while standing on the ground employing clamping tables or threading machines to clamp or hold either the pipe or the pipe fitting, and the mating pipe or fitting is gripped with a pipe wrench. Working on the ground using clamping tables or the like does marginally reduce the physical exertion as well as the risk of personal injury. However, the majority of the plumbing work involving the threading and unthreading of pipes and pipe fittings has to be done overhead while working in the air on a platform or the like.

The practice of using pipe wrenches for the threading, unthreading, tightening and loosening of threaded pipe and threaded pipe fittings has existed from the inception of threaded pipe and threaded pipe fittings, with virtually no change to pipe wrench design, other than the introduction of self-adjusting pipe wrenches. Despite substantial awareness of worker safety, as well as increased legislation in this field, no powered tool has yet been developed specifically for this potentially unsafe, physically strenuous, everyday process wherein two pipe components must be rotated relative to one another. Numerous electric, pneumatic and hydraulic power tools, including nut setters, air wrenches, electric screwdrivers, electric drills, impact wrenches, riveters, threading tools, etc., are currently available for practically every traditionally manual operation. All these power tools significantly improve worker safety, productivity and mobility, in addition to drastically reducing worker fatigue.

Thus, a powered adjustable pipe wrench solving the aforementioned problems is desired.

SUMMARY OF THE INVENTION

The powered adjustable pipe wrench has two laterally spaced jaw sets. One of the jaw sets includes a motorized drive for rotating one of the pipe components, while the other jaw set has non-rotating jaws for holding the second pipe component stationary relative to the first component. Thus, the powered adjustable pipe wrench produces equal and opposite torques to rotate the two pipe components relative to one another, with zero net torque being applied to the tool.

A first embodiment of the device includes two semicircular jaws in each jaw set, with each jaw set having a stationary jaw and an opposite openable jaw. The stationary jaw half of the powered jaw set includes a motorized drive to rotate a pipe or fitting clamped therein, while the non-powered jaw set clamps the other pipe component to prevent relative rotation thereof while the powered jaw set rotates its component.

The second embodiment includes rectilinearly adjustable jaw sets, again with one jaw set including a motorized drive to rotate the pipe component and the other jaw set serving to hold its pipe component stationary relative to the component held in the motorized jaw set. Each embodiment is adjustable to compensate for different pipe and fitting diameters. An elongate handle and supplemental handgrip are provided, as well as switches for controlling the amount of torque produced, rotational speed, and other factors.

A third embodiment also includes rectilinearly adjustable jaw sets, but further includes a mechanism for adjusting the relative positions of the laterally opposed jaw pairs to accommodate different pipe and pipe fitting diameters. This embodiment includes a spade handgrip configuration with actuating trigger, as well as switches for controlling the amount of torque produced, rotational speed, and other factors.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
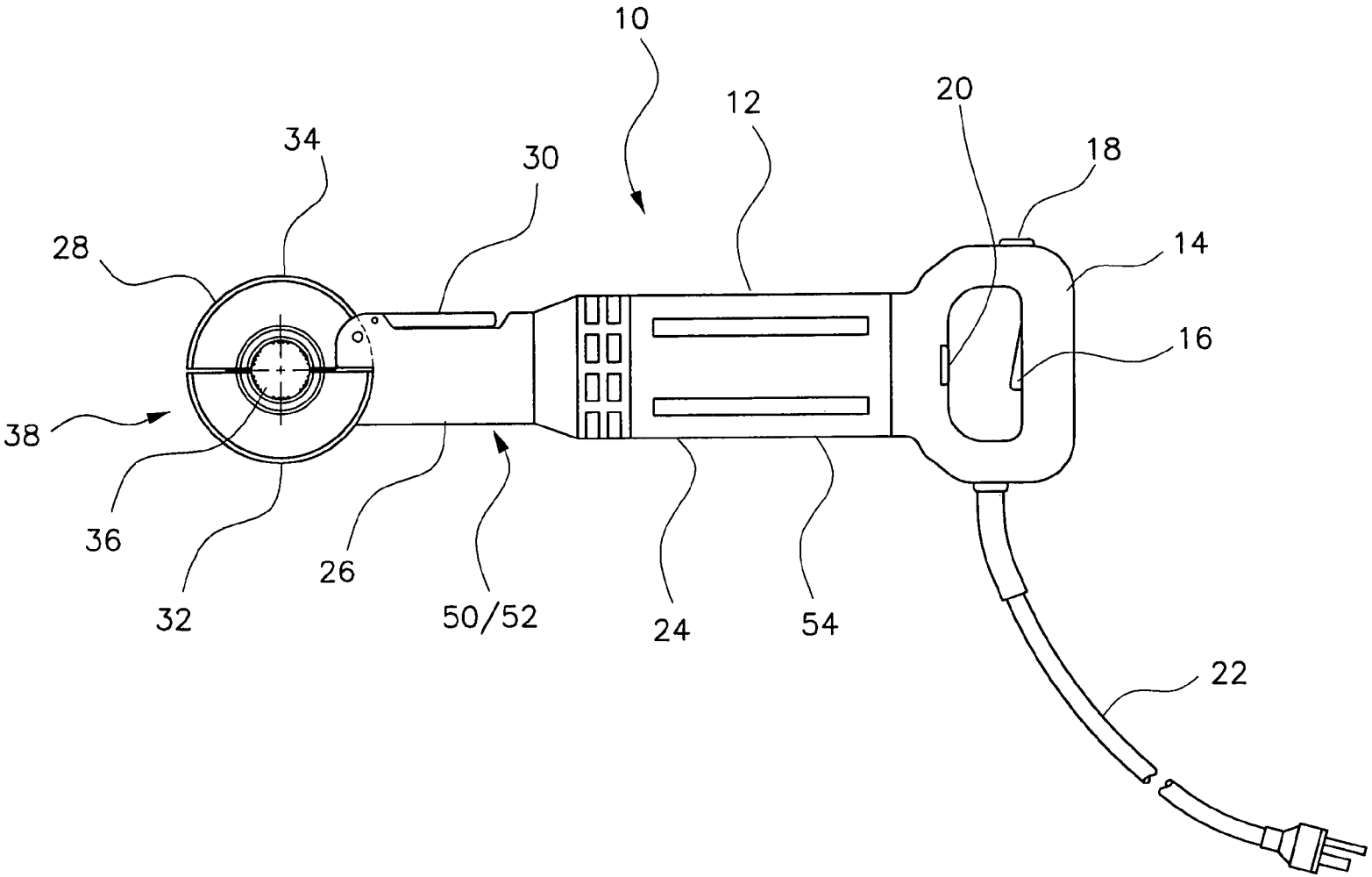
FIG. 1 is a side elevation view of a first embodiment of the powered adjustable pipe wrench according to the present invention.
Figure 2:
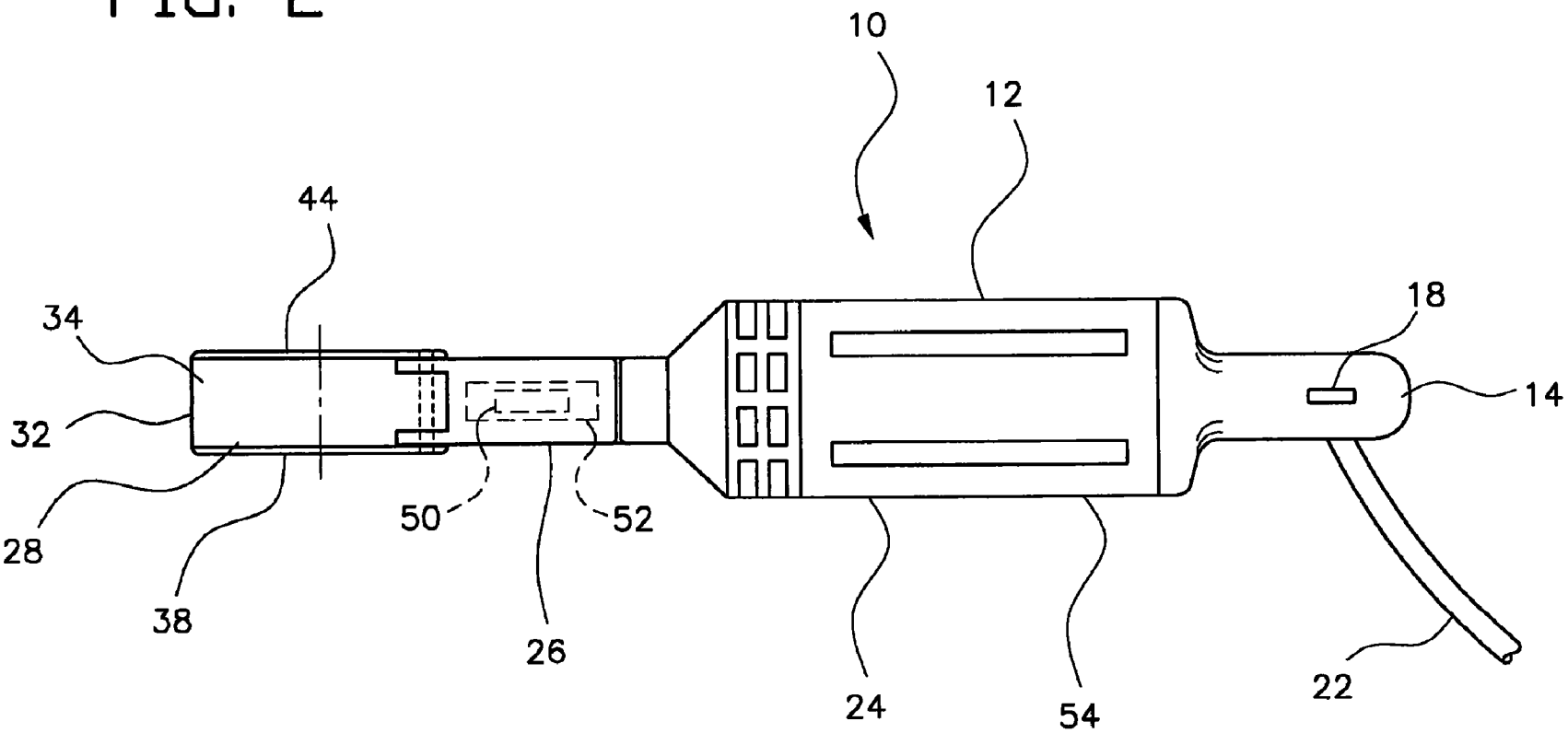
FIG. 2 is a top plan view of the pipe wrench of FIG. 1, showing further details thereof.

FIGS. 1 and 2 show a side view and a top view, respectively, of a powered adjustable pipe wrench 10 according to the present invention. The pipe wrench 10 has a main body 12, an operator's handle 14 incorporating an activating lever 16, an on/off switch 18, a torque-setting knob 20, and a power input 22. An electric cord power input 22 is shown, but it should be understood and be obvious that the invention could use battery, pneumatic or hydraulic power. The powered adjustable pipe wrench 10 in FIGS. 1 and 2 also is shown as having, integral to the main body 12, a motor housing 24, a gearbox housing 26, and a clamping head 28, as well as a locking lever 30.

Figure 3:
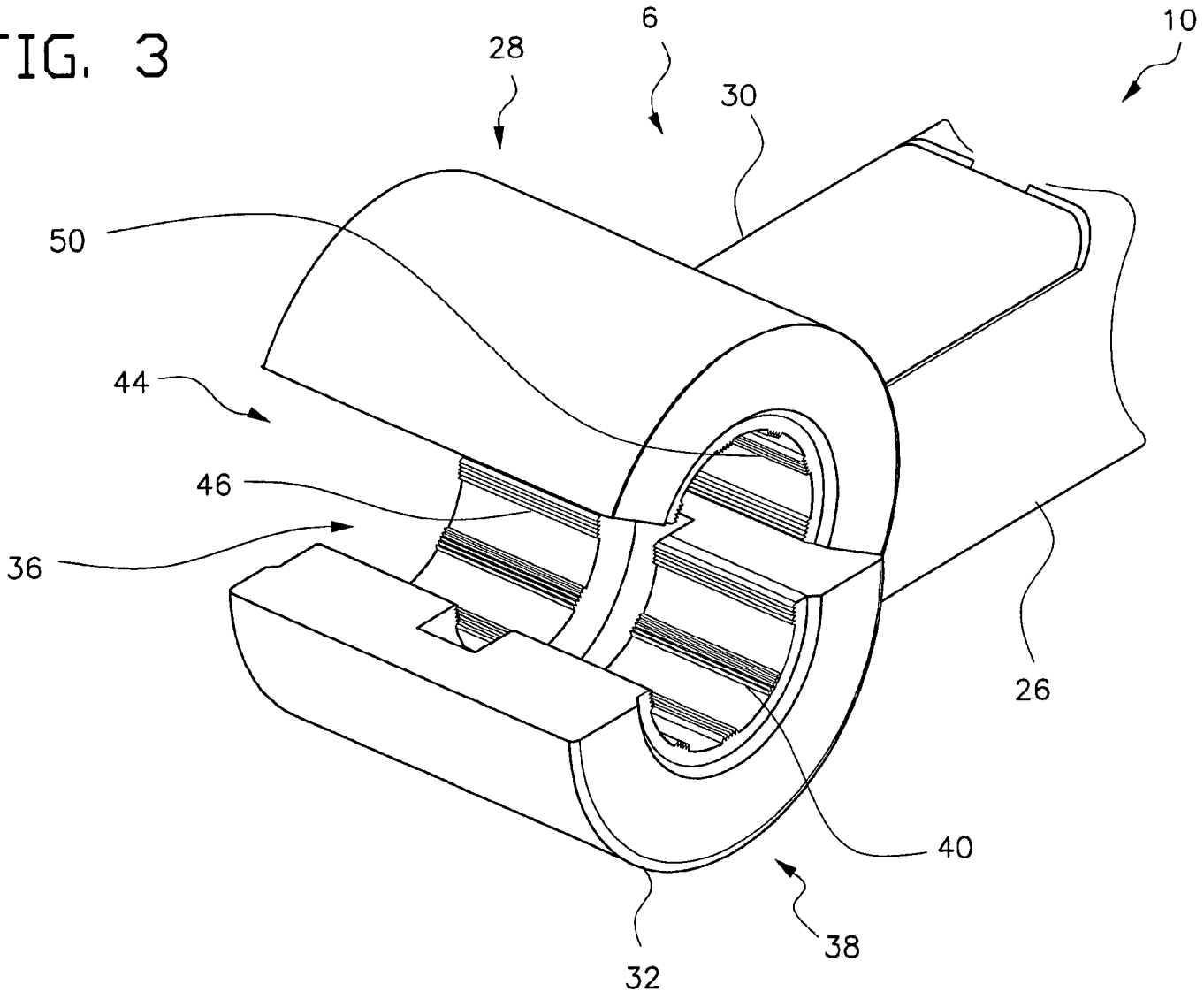
FIG. 3 is a detailed perspective view of the opened jaws of the pipe wrench of FIGS. 1 and 2, showing further details thereof.
Figure 4:
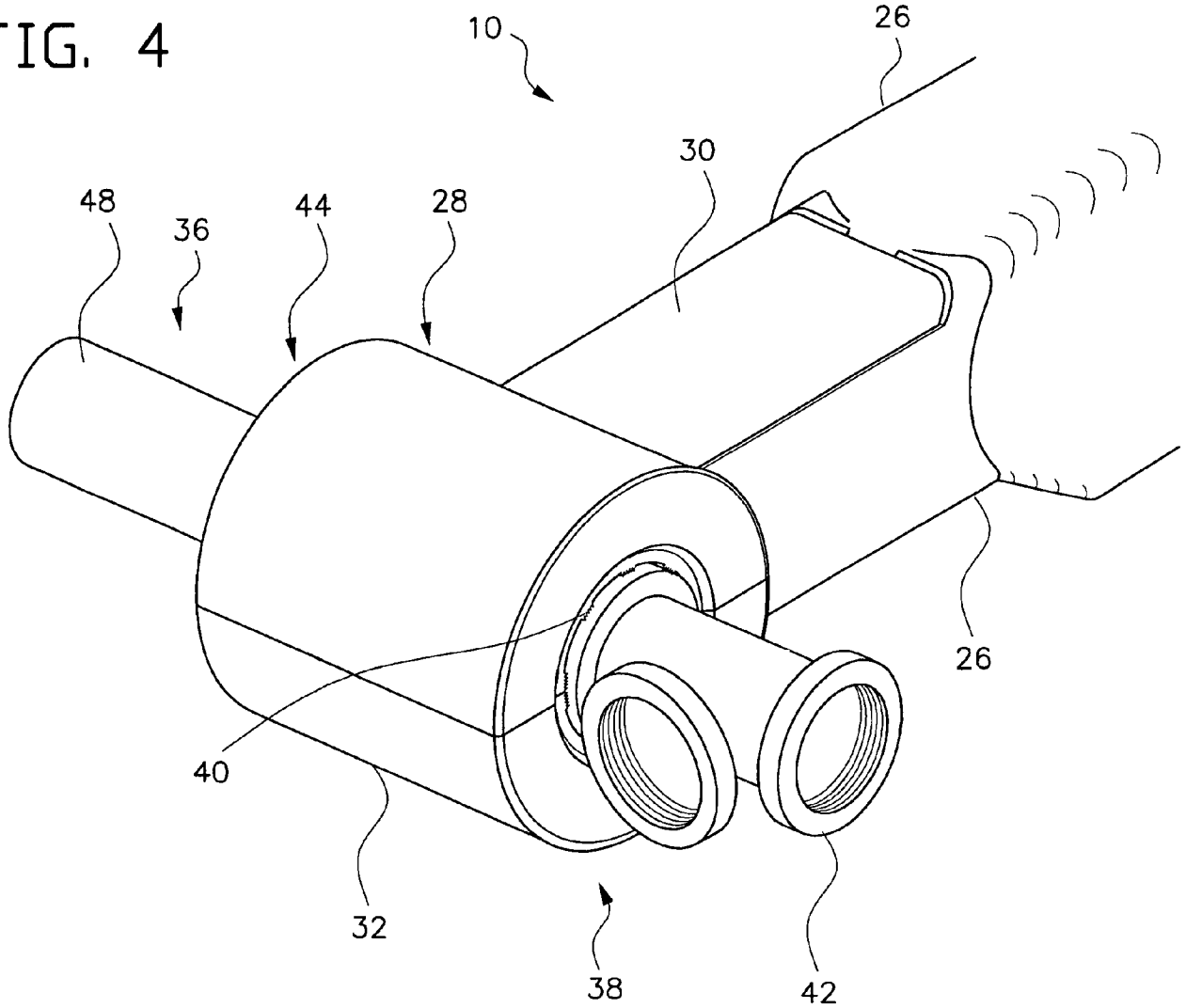
FIG. 4 is an environmental perspective view of the closed jaws of the pipe wrench of FIGS. 1 through 3, showing the device clamped onto a threaded pipe and threaded pipefitting.

The clamping head 28 shown in FIGS. 1 and 2, as well as in the enlarged views of FIGS. 3 and 4, has a stationary head member 32 and a hinged head member 34. When clamped together, the clamping head 28 of pipe wrench 10 defines a cylindrical through-cavity 36, as shown in FIGS. 1, 3, and 4. Internally, on one side 38 of the clamping head 28, non-rotating jaws 40, which are rigidly fixed to both the stationary head member 32 and the hinged head member 34, are spaced along the internal perimeter of the through-cavity 36 and adjusted to provide a stationary non-rotating clamp, e.g., onto a threaded pipe fitting 42, as shown in FIG. 4. Internally, on the opposite side 44 of the clamping head 28, rotating semi-circular jaws 46 (shown in FIG. 3) having gripping teeth thereon are spaced along the internal perimeter of the through cavity 36 and adjusted to clamp onto, e.g., the threaded pipe 48 of FIG. 4.

The rotating jaws 46 are powered for circular rotation for threading of pipe into or out of the threaded pipe fitting 42 by reduction gearing 50 through gearbox 52 powered by drive motor 54. Threading in, threading out, or tightening and loosening of threaded pipe and pipe fittings is accomplished by selecting the direction of rotation with the in/off/out switch 18, shown in FIGS. 1 and 2.

FIG. 4 shows a threaded pipe fitting 42 clamped in the non-rotating side 38 or non-rotating jaws 40 of the device, holding the pipe fitting 42 stationary while rotating or threading the threaded pipe 48 on the opposite side 44 by means of the rotating clamping jaws 46. This operation can be reversed with the threaded pipe 48 being held from rotating and rotating the threaded pipe fitting 42 by turning the powered adjustable pipe wrench 10 over and clamping the threaded pipe 48 on side 38 and clamping the threaded pipe fitting 42 on side 44. This reversing procedure is common practice in plumbing skill.

FIGS. 5 through 9 of the drawings provide illustrations of a second embodiment of the powered adjustable pipe wrench, designated as wrench 100. The powered adjustable pipe wrench 100 includes an elongate housing 102 having a handle portion 104 extending therefrom and a first jaw portion 106 at the end opposite the handle 104. The first jaw portion 106, i.e., the jaw portion integral with the housing 102, includes a powered, rotary grip assembly disposed therein, with the rotary grip assembly having arcuately spaced, coplanar first and second powered rollers 108*a* and 108*b* (shown in FIGS. 7 and 8) therein. The two rollers 108*a* and 108*b* are mounted on respective shafts 109*a* and 109*b*, with both shafts and the second roller 108*b* being shown in FIG. 8, roller 108*a* being mounted on shaft 109*a* and hidden behind the gear train in FIG. 8.

Figure 8:
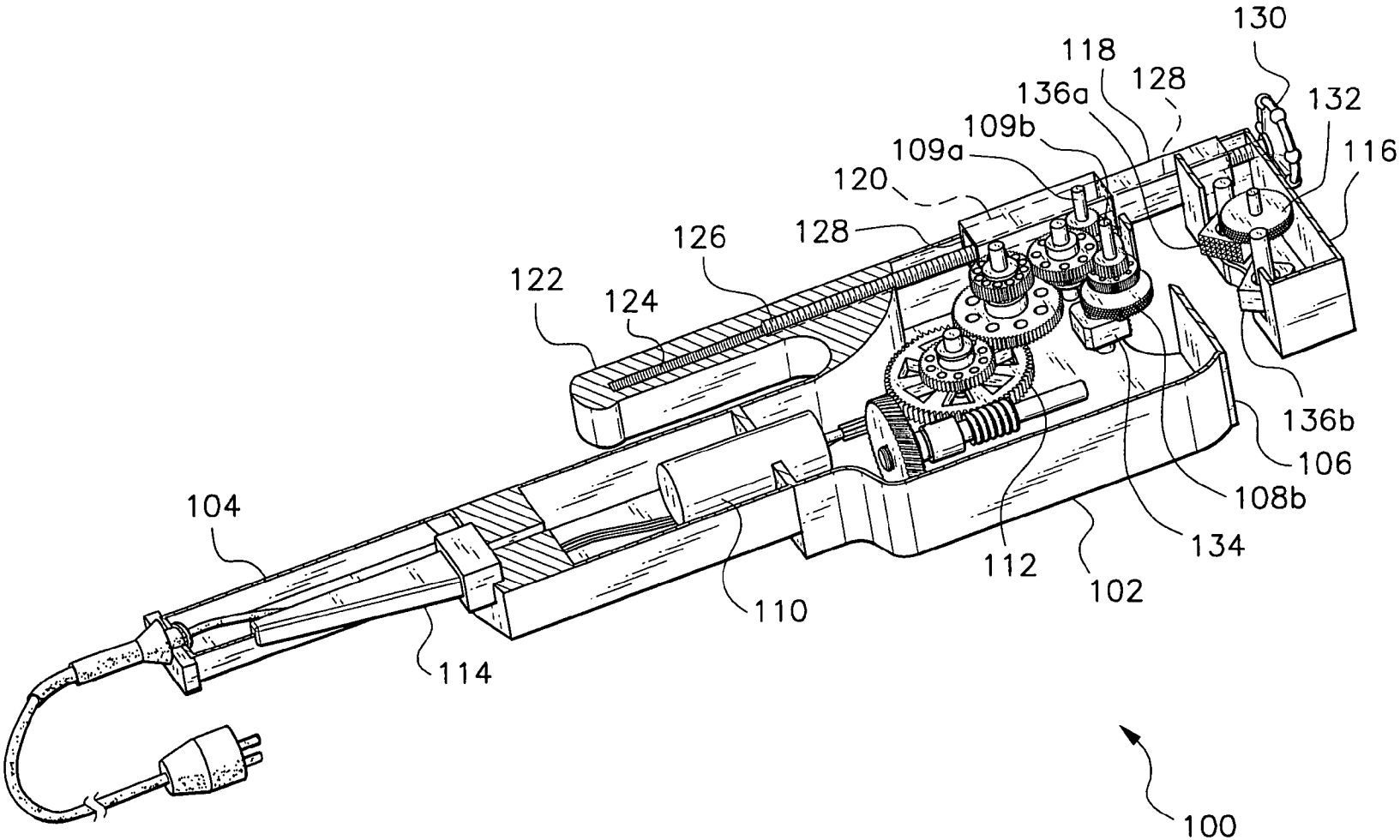
FIG. 8 is a perspective view in axial section of the pipe wrench of FIGS. 5 through 7, showing details of the internal mechanism.
Figure 9:
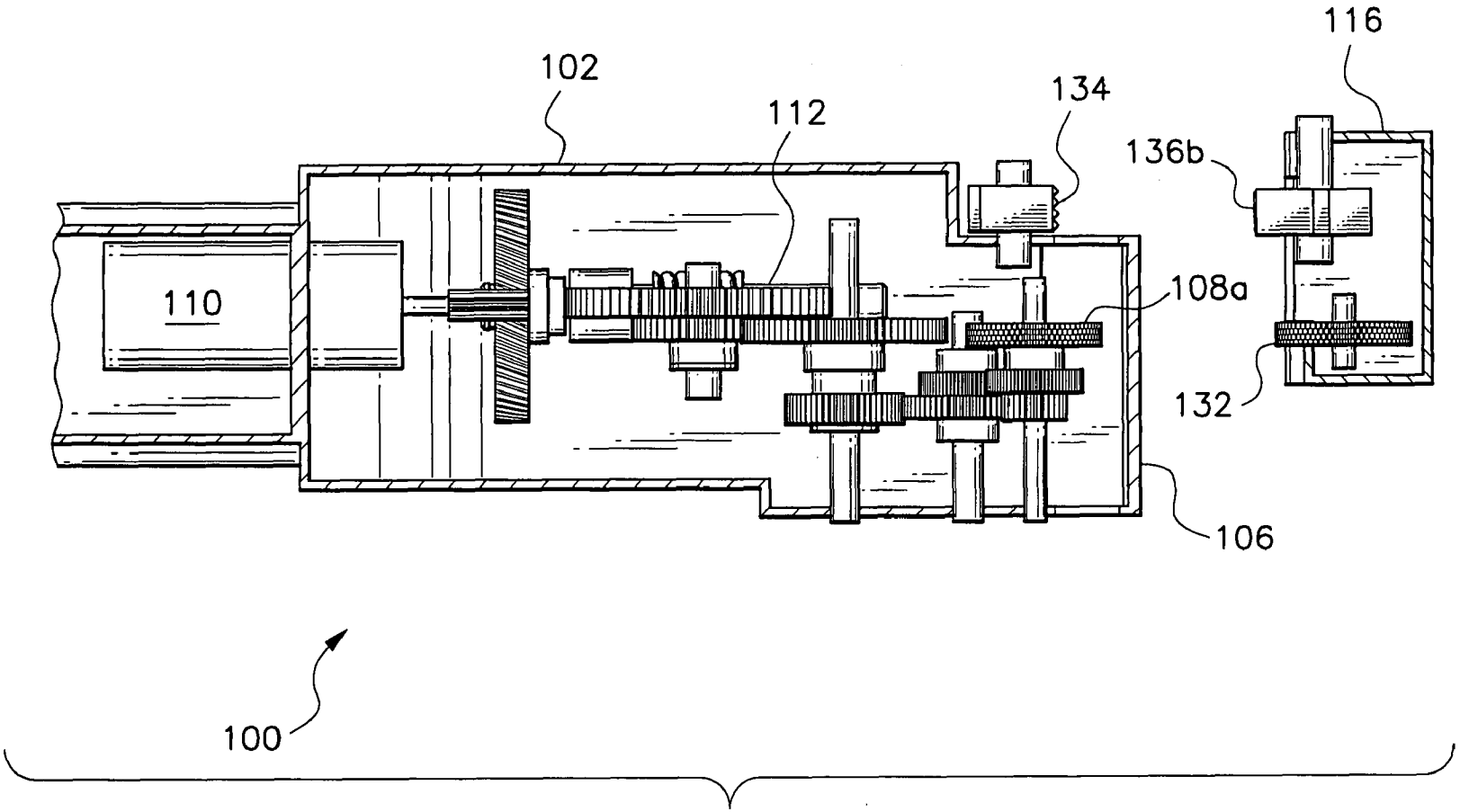
FIG. 9 is a section view drawn along lines 9-9 of FIG. 7.

A motor 110, shown in FIGS. 8 and 9, drives the powered rollers 108*a* and 108*b* through a gear train 112, which mechanically couples the motor 110 to the rollers 108*a*, and 108*b*. The gear train 112 provides significant rotational speed reduction from the motor 110 to the powered rollers 108*a* and 108*b*, and thus significant torque multiplication, allowing a relatively small motor to provide sufficient power for the wrench 100. The motor 110 may comprise an ac or dc electric motor, as desired, with the ac motor receiving electrical power from a conventional electric cord, as shown. The body or housing portion 102 of the device, particularly that portion from which the handle 104 extends, provides sufficient volume to contain a conventional battery pack for powering a dc electric motor. Alternatively, the motor 110 could comprise a pneumatic motor receiving power from a portable air compressor or other suitable pneumatic power source, or a hydraulically powered motor receiving power from a source of hydraulic pressure.

Any of the above motors may be controlled by a suitable switch, as is known in the art of motor operation and speed control. A control switch 114 is illustrated in FIG. 8, with the switch being spring-loaded to a normally off (or electrically open) first position and squeezed or otherwise manipulated to a second position to close the circuit for motor operation and corresponding rotation of the rollers 108*a* and 108*b*. In the case of electric operation, the switch 114 may operate a rheostat or other electric regulation device to control the torque and/or speed of the motor 110. In the cases of pneumatic and hydraulic motors, the switch may respectively control pneumatic or hydraulic pressure or flow, as known in the art.

Figure 7:
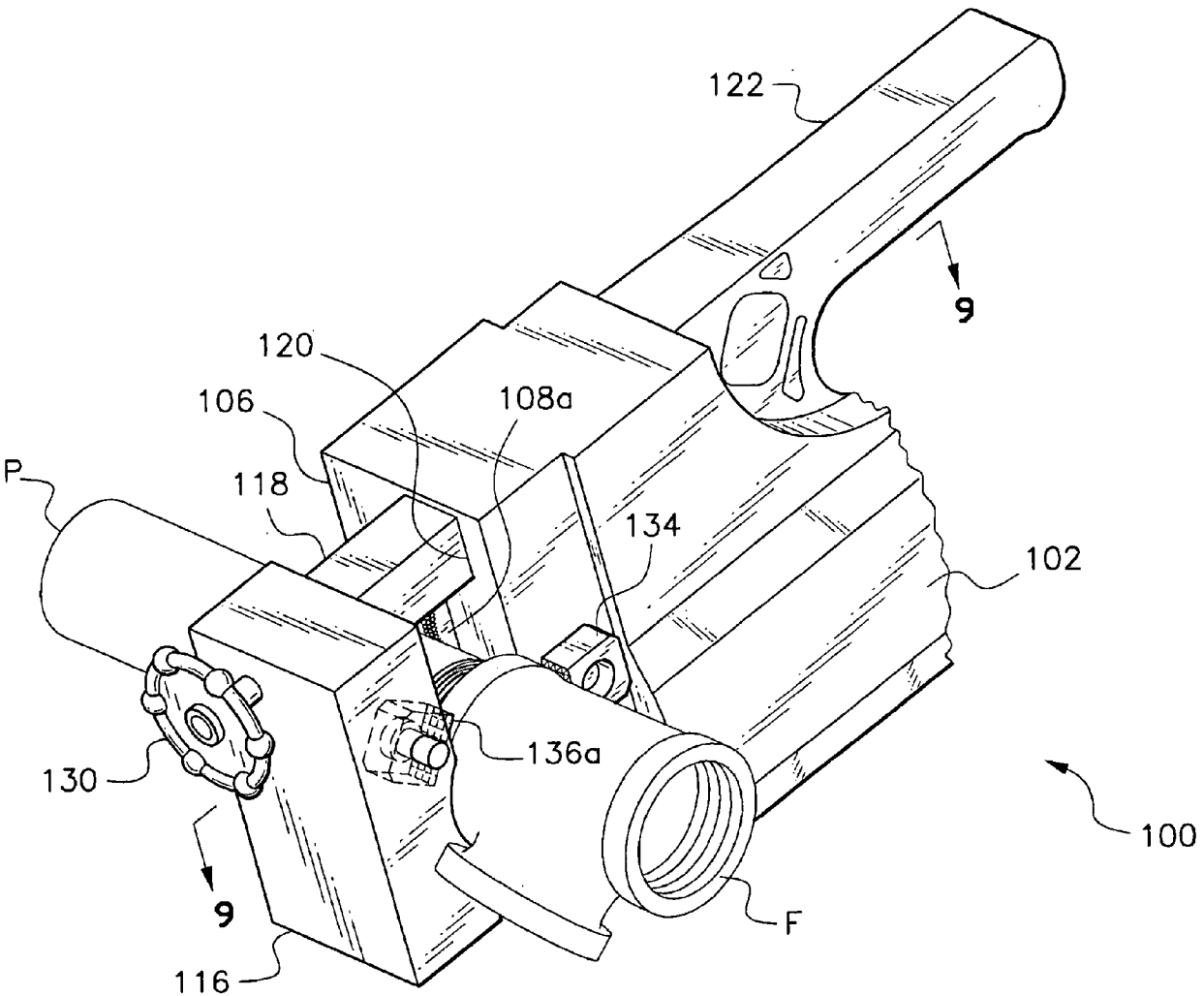
FIG. 7 is a detailed perspective view of the jaw assembly portion of the pipe wrench of FIGS. 5 and 6, showing further details.

A rectilinearly adjustable second jaw portion 116 is disposed diametrically opposite the first jaw portion 106. The second jaw portion 116 has an adjuster shaft 118 extending therefrom, with the second jaw adjuster shaft 118 engaging a second jaw receptacle 120 (shown in FIG. 8) within the housing 102. The second jaw adjuster shaft 118 and second jaw receptacle 120 within the housing 102 are of mutually congruent, non-circular cross section, e.g., square, as shown in FIGS. 7 and 8, in order to prevent axial rotation of the second jaw adjuster shaft 118 relative to its receptacle 120 (alternatively, shaft 118 may be circular with a longitudinally extending key and receptacle 120 may have a corresponding keyway defined therein for the same purpose). The second jaw adjuster shaft 118 slides linearly in and out of its receptacle 120 in the housing 102, thus adjusting the span of the opening between the first jaw portion 106 and the adjustable second jaw portion 116.

The housing 102 includes a secondary handgrip 122 extending rearwardly from the first jaw portion 106, laterally offset from the main portion of the housing 102 and generally aligned with the second jaw receptacle 120 of the housing 102 and the second jaw adjuster shaft 118 adjustably disposed therein. This secondary handgrip 122 portion of the housing includes an internally threaded passage 124 therein, as shown in FIG. 8, concentric with and extending from the second jaw receptacle 120. A threaded adjuster 126 extends through an adjuster passage 128 disposed through the second jaw portion 116 and axially through the adjuster shaft 118, with the adjuster 126 engaging the internally threaded passage 124 of the housing 102, or more precisely the secondary handgrip portion 122 of the housing 102, in order to adjust the span of the opening between the first jaw portion 106 and the adjustable second jaw portion 116. An adjustment knob 130 extends from the distal end of the adjuster 126, i.e., the end extending from the adjustable second jaw portion 116, for a user of the wrench 100 to adjust the span between the first jaw portion 106 and second jaw portion 116.

In order to allow the two powered rollers 108*a* and 108*b* to rotate a length of pipe or pipe fitting clamped within the jaws 106 and 116, another roller 132 is provided within the second jaw portion 116. This non-powered, idler rotary grip element 132 is at least generally coplanar with the two powered rollers 108*a* and 108*b*, as shown particularly in FIG. 9, in order that an object having a round cross section (e.g., a pipe, a pipe fitting, etc.) will be gripped therebetween. The pipe or round object is thus rotated between the two jaws 106 and 116 when the object is gripped firmly between the jaws 108*a*, 108*b*, and 132 and power is applied to the motor 110.

The above-described mechanism serves to rotate the pipe, pipe fitting, etc., between the two jaws 106 and 116 when the wrench 100 is operated. However, an adjacent length of pipe or pipefitting must be held stationary in order to rotate one pipe component relative to the other to assemble or disassemble the two components. This is accomplished by a stationary jaw element 134 disposed within the first jaw portion 106, as shown in FIGS. 7 and 8, and a pair of stationary jaw elements 136*a* and 136*b* disposed within the second jaw portion 116, shown in FIGS. 7 through 9. The stationary jaw element 134 is laterally displaced (or axially displaced relative to an axis normal to the plane of the handle 104 and jaws 106, 116) from the powered rollers 108*a* and 108*b* of the first jaw portion 106, with the stationary jaw elements 136*a*, 136*b* of the second jaw portion 116 also being laterally displaced (or axially displaced relative to an axis normal to the plane of the handle 104 and jaws 106, 116) from the non-powered roller 132. However, the various stationary jaw elements 134, 136*a*, and 136*b* are all coplanar with one another in order to grip a pipe component firmly therebetween when the second jaw component 116 is tightened as described above. The stationary jaw elements 134, 136*a*, and 136*b* may be mounted on pivot pins to allow them to pivot slightly to align with the surfaces of various diameters of pipe clamped therebetween, but they do not rotate, as do the rollers 108*a*, 108*b*, and 132. The fixed elements 134 through 136*b*, and any pipe component clamped therebetween, do not move relative to the jaws 106 and 116 once the wrench 100 has been tightened upon the pipe assembly.

Figure 5:
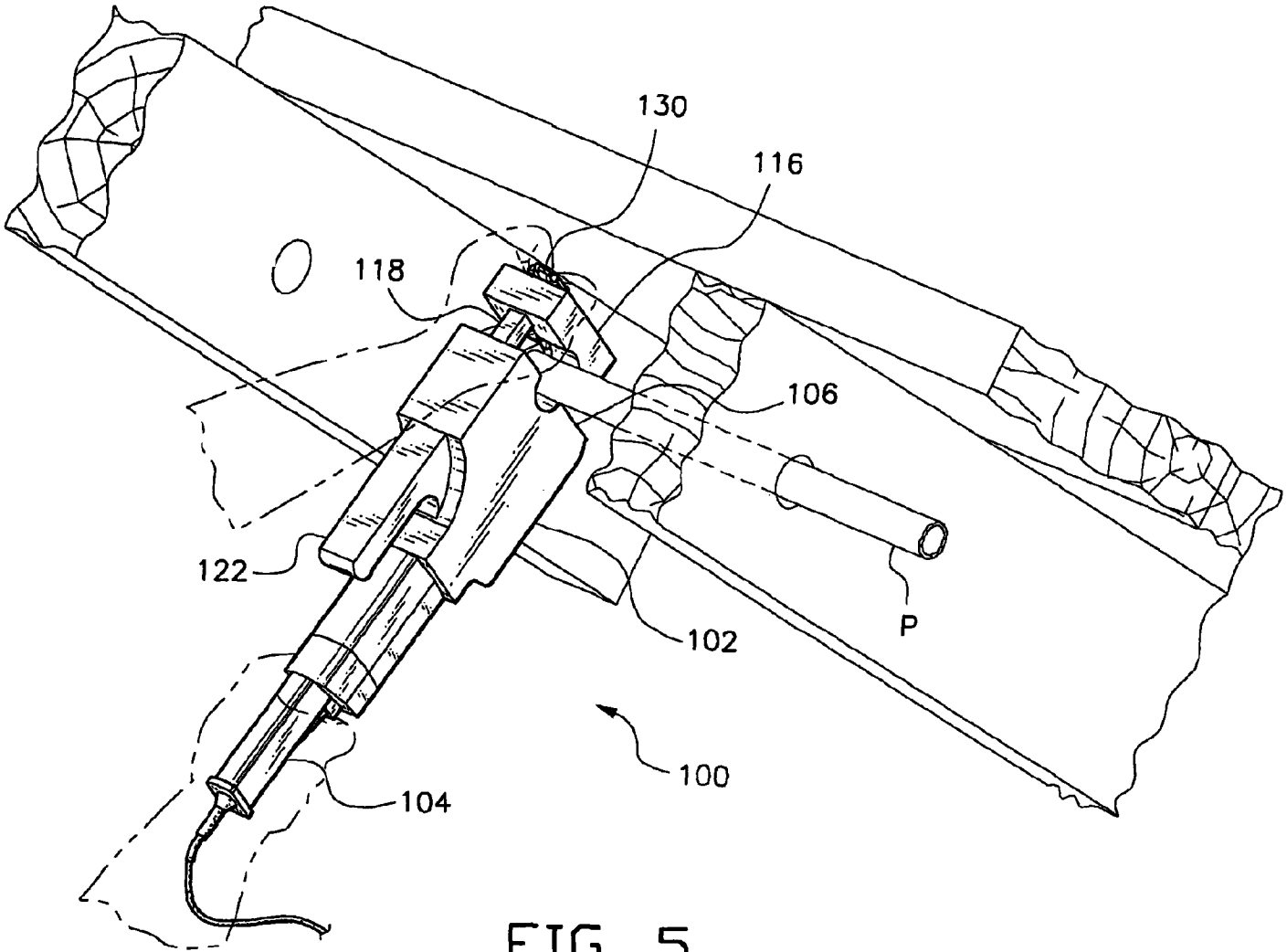
FIG. 5 is an environmental perspective view of a second embodiment of a powered adjustable pipe wrench according to the present invention, showing its placement about a pipe assembly.
Figure 6:
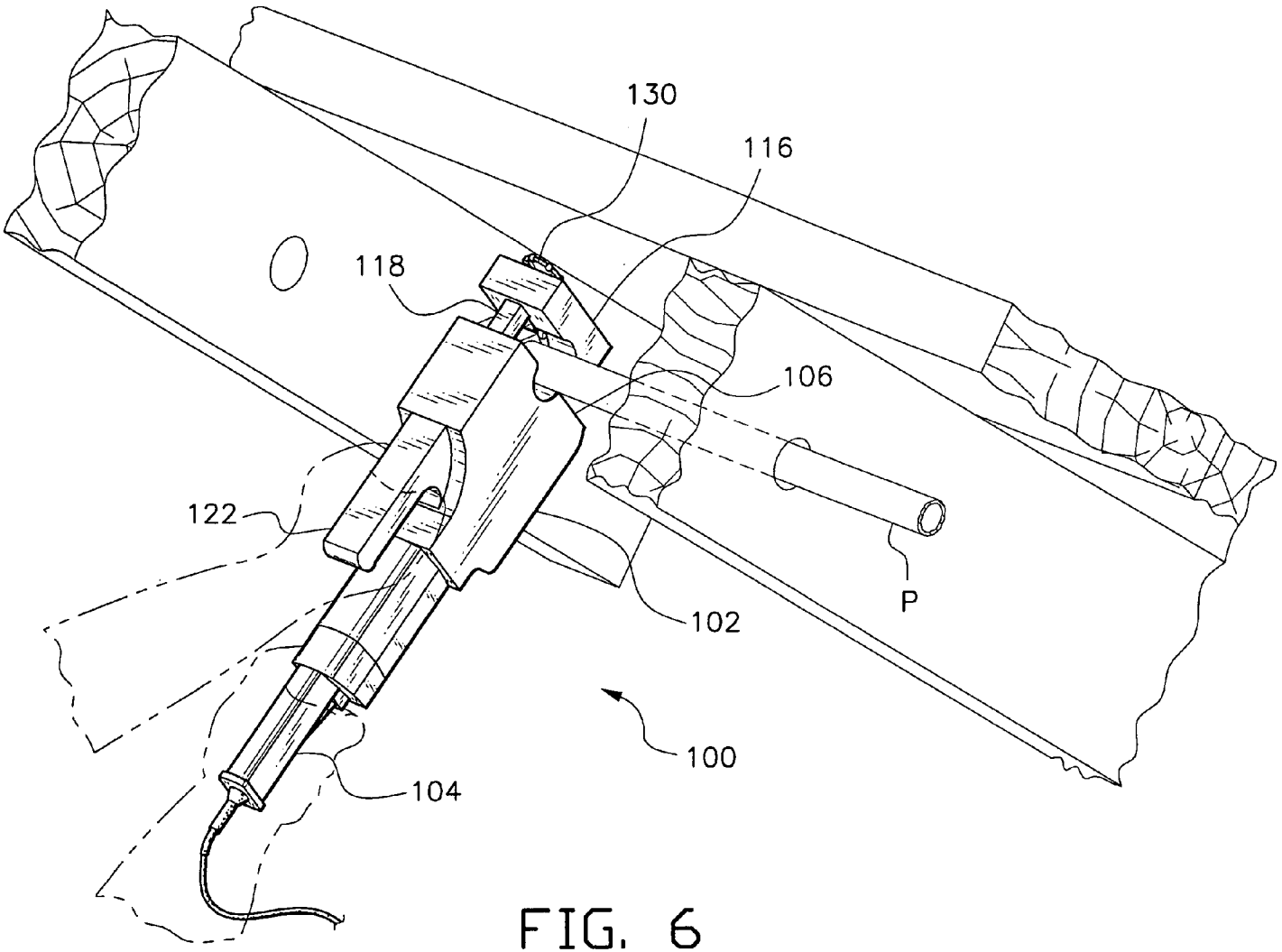
FIG. 6 is an environmental perspective view of the pipe wrench of FIG. 5, showing its operation on a pipe assembly.

FIGS. 5 and 6 illustrate the operation of the powered adjustable pipe wrench 100, with FIG. 7 providing a detailed view of the two jaw portions 106 and 116 gripping a length of pipe P and pipe fitting F. In FIG. 5, the wrench 100 has been placed about a pipe assembly P, with the operator of the wrench shown tightening the adjustment knob 130 to lock the pipe assembly P securely between the two jaws 106 and 116. In FIG. 6, the operator is actuating the switch and switch lever 114 to drive the motor within the housing 102, thereby actuating the gear train 112 therein and causing the two powered rollers 108*a* and 108*b* to rotate, thereby rotating the pipe component gripped between the two powered rollers 108*a*, 108*b* and the non-powered rotary grip element 132 of the second jaw 116.

The portion of the pipe that is to remain relatively stationary is gripped between the various stationary jaw elements 134 through 136*b*, as shown by the stationary pipe fitting F in FIG. 7. Thus, the wrench 100 applies torque through the two powered rollers 108*a* and 108*b* to rotate a pipe component gripped thereby while simultaneously holding the adjoining pipe component stationary relative to the first component. The opposing torques between the rotary and stationary components and jaw elements are canceled due to the powered rollers 108*a* and 108*b* being captured within the structure of the wrench 100. Thus, the operator of the wrench 100 need only hold the actuating switch as required to operate the wrench, without need to apply force to oppose any torque developed by the tool. The motor 110 may be a reversible electric motor to facilitate either threading piping elements together or unthreading piping elements.

Figure 10:
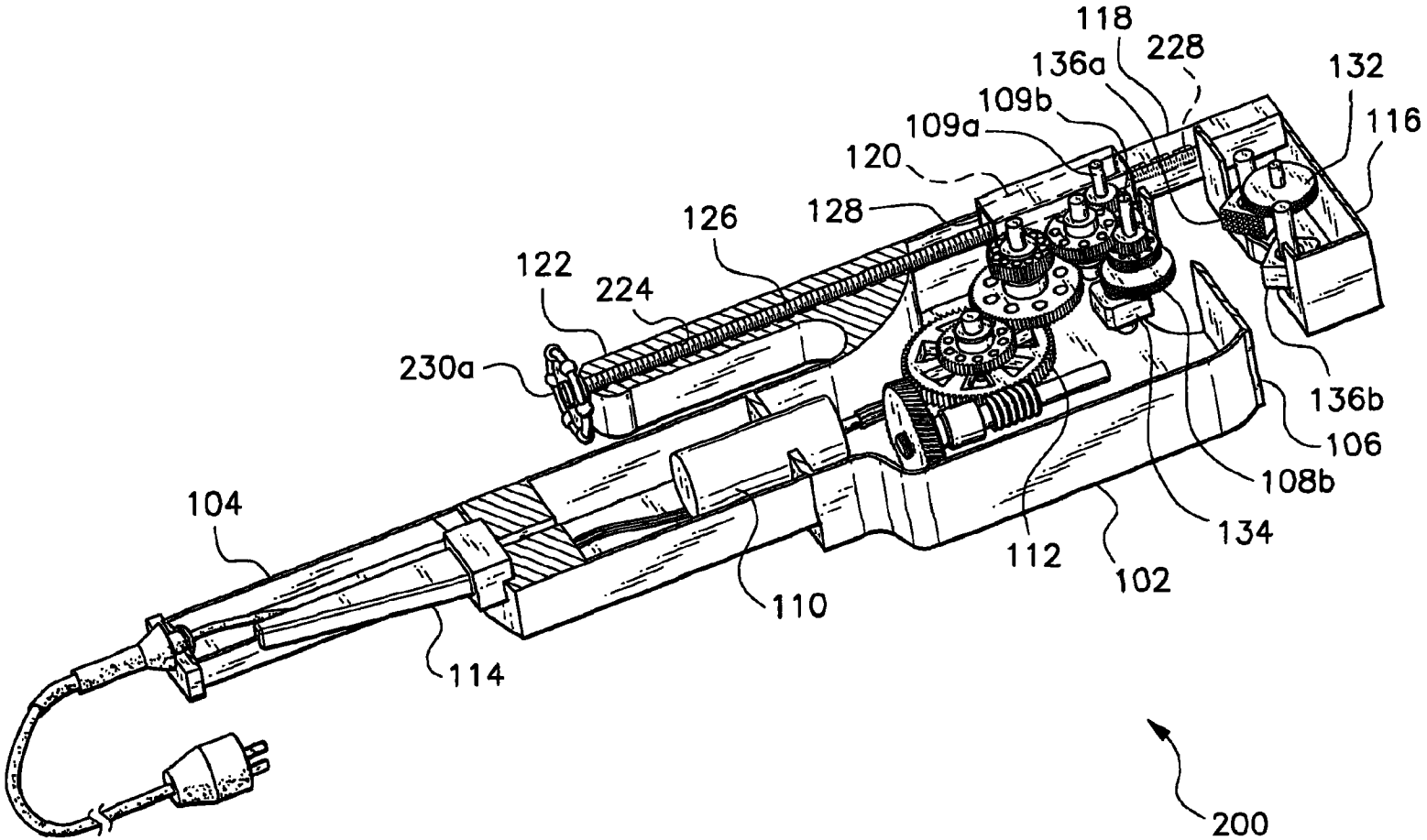
FIG. 10 is a perspective view in axial section similar to FIG. 8, but illustrating an alternative location for the adjuster knob.
Figure 11:
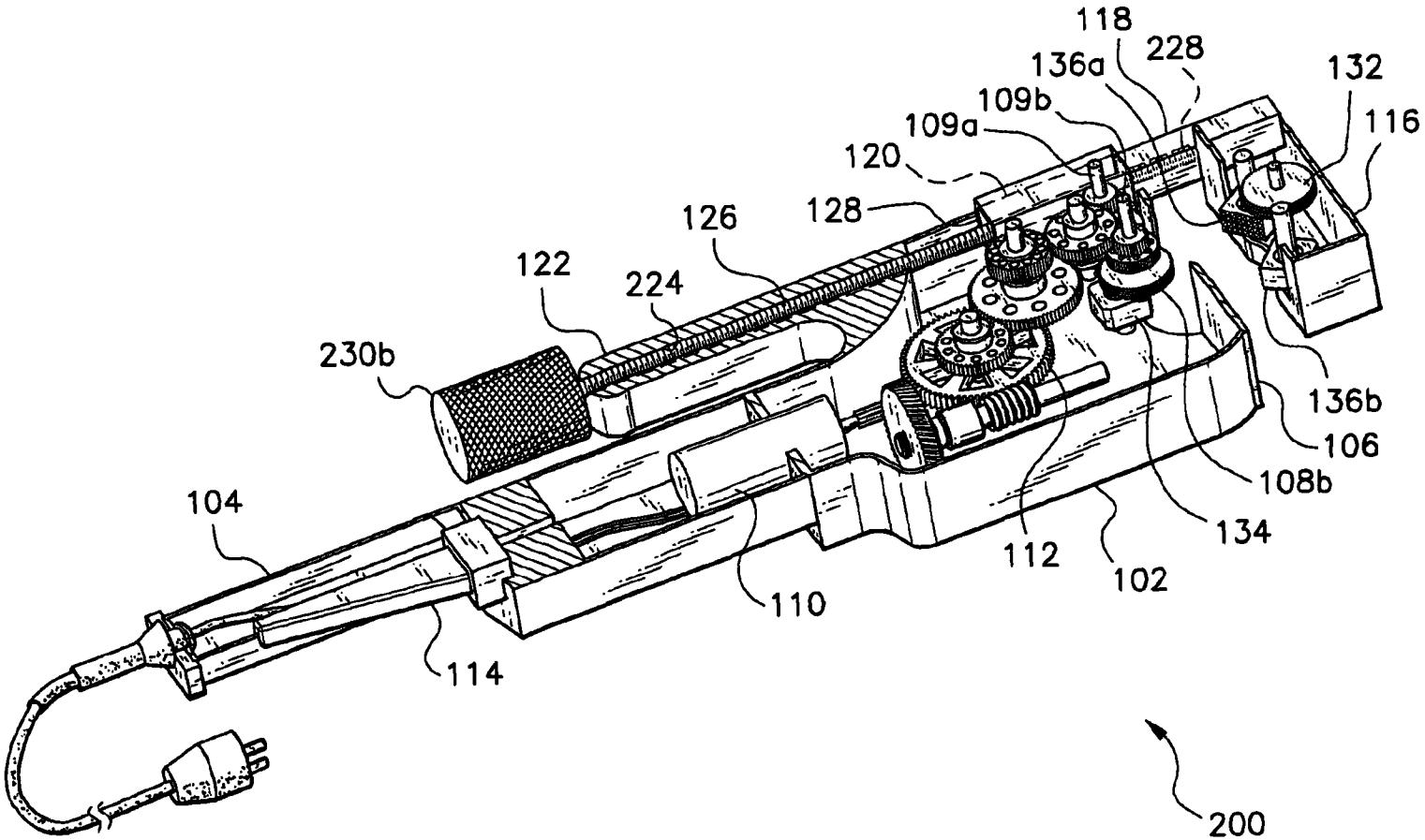
FIG. 11 is a perspective view in axial section similar to FIG. 10, but illustrating an alternative configuration for the adjuster knob.

FIGS. 10 and 11 provide perspective views in axial section of alternative embodiments of the powered adjustable pipe wrench, in which various configurations of the adjuster knob have been relocated relative to the wrench embodiment 100 of FIGS. 5 through 9. Identical reference numerals are used to indicate substantially identical components in the powered wrench embodiments of FIGS. 5 through 11, with only the overall wrenches and differently configured components thereof being assigned different reference numerals. The powered wrench 200 of FIG. 11 has substantially the same configuration as the wrench 200 of FIG. 10, with the exception of the differently configured adjuster knob 230*b*.

The powered wrench 200 of FIGS. 10 and 11 is substantially the same as the powered wrench 100 of FIGS. 5 through 9, with the exception of the relocation of the jaw adjustment knob 230*a* or 230*b* and necessary changes to the associated mechanism. Rather than placing the adjuster knob at the distal end of the adjustable second jaw portion 116 of the device and requiring the user to reach to the opposite end of the wrench from the handle 104, the adjuster knob 230*a* (or 230*b*) of the wrench 200 has been placed at the distal end of the secondary handgrip 122, i.e., the end closest to the major handle portion 104 of the device. This results in an interchange of the threaded and unthreaded portions of the adjuster passages through the secondary handle 122 and the jaw adjuster shaft 118.

In the wrench 200 of FIGS. 10 and 11, the internal passage 224 is unthreaded to allow the threaded adjuster 126 to rotate therein without axial advancement or retraction within the passage 224. However, the adjuster passage 228 through the second jaw adjuster shaft 118 is internally threaded. Thus, rotation of the adjuster knob 230*a* or 230*b* results in the threaded shaft 126 either drawing the second jaw adjuster shaft 118 and its attached second jaw 116 closer to the fixed first jaw 106, or extending the second jaw adjuster shaft 118 and second jaw 116 farther from the first jaw 106. This relocation of the adjuster knob 230*a* or 230*b* facilitates manipulation of the tool 200 by the user, as there is no longer a need to reach to the opposite end of the tool.

Figure 12:
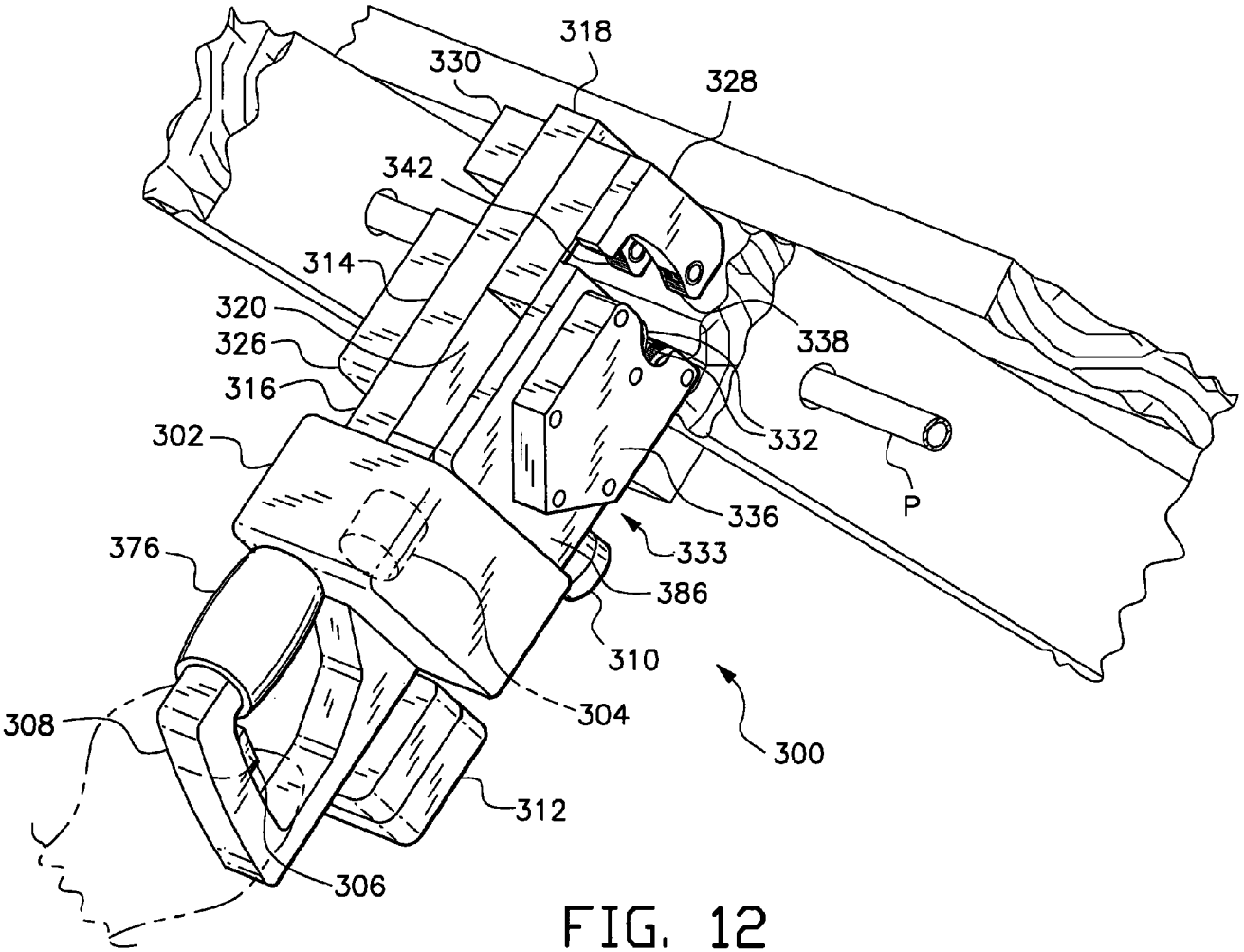
FIG. 12 is an environmental perspective view of a third embodiment of a powered adjustable pipe wrench according to the present invention.
Figure 13:
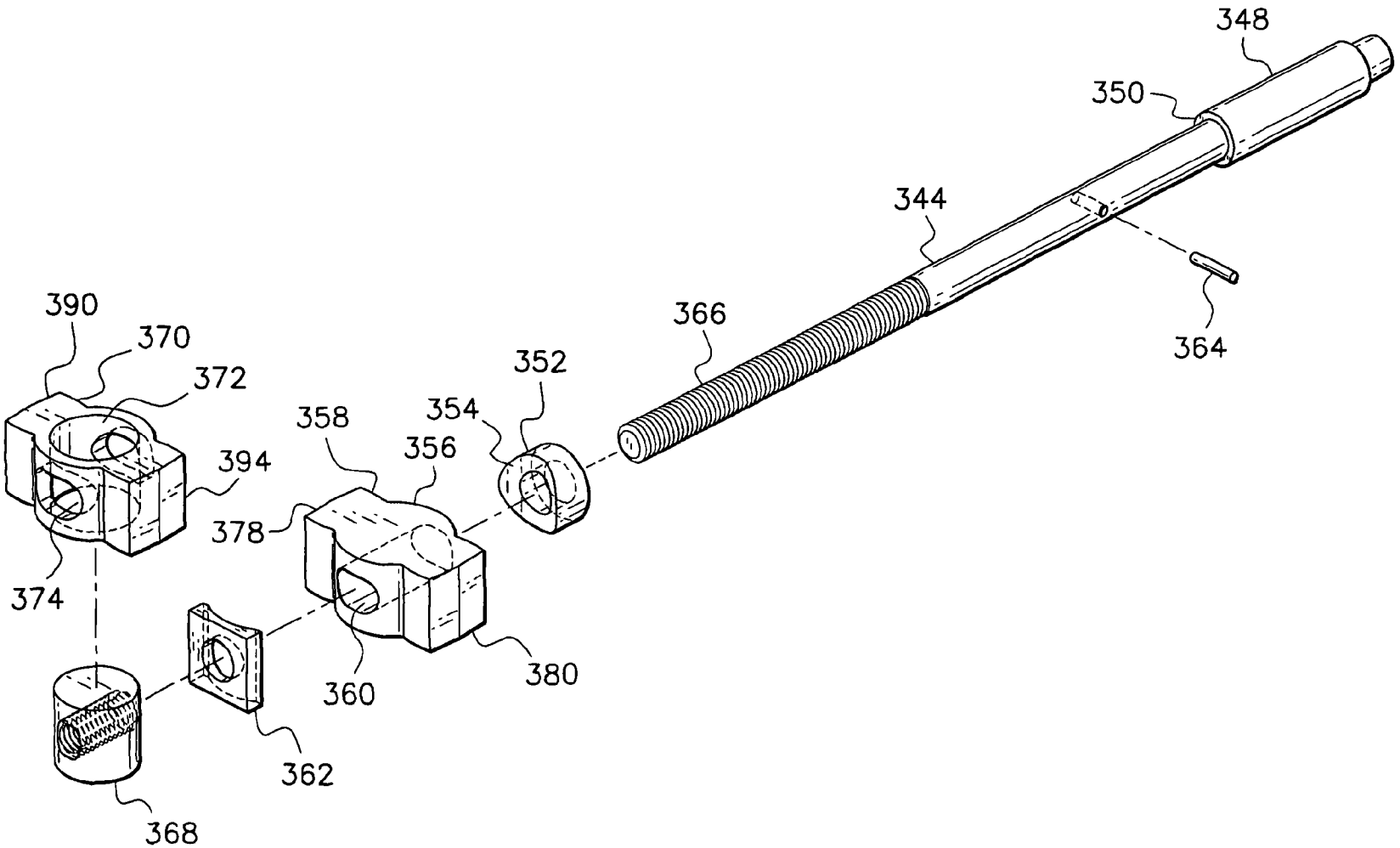
FIG. 13 is an exploded perspective view of the jaw adjuster shaft assembly of the pipe wrench of FIG. 12, showing its pivot blocks for adjusting the relative positions of the laterally opposed jaw pairs.

FIGS. 12 through 17 illustrate an additional embodiment of the powered adjustable pipe wrench, designated as pipe wrench 300. FIG. 12 provides an environmental perspective view of the powered adjustable pipe wrench 300 being used to work on a pipe assembly P installed in a structure. The wrench 300 includes a motor housing 302, in which a motor 304 (e.g., electric, hydraulic, pneumatic, etc., shown in broken lines in FIG. 12) is installed. The motor 304 drives a worm gear shaft that, in turn, rotates an initial gear of the gear train, similar to the arrangement illustrated for the wrench 100 shown in FIGS. 8 through 11. Motor 304 actuation is controlled by a conventional switch 306 disposed in the spade grip 308. The switch 306 may be used to control the speed and/or torque of the motor 304 through a controller 310 comprising a conventional rheostat (for electric motors) or pressure or flow restriction (for hydraulic or pneumatic motors), as is known in the art. Power for an electric motor may be provided by a battery pack 312 or by means of a conventional electric cord, or by means of a conventional hydraulic or pneumatic line in the case of a hydraulic or electric motor.

Figure 14:
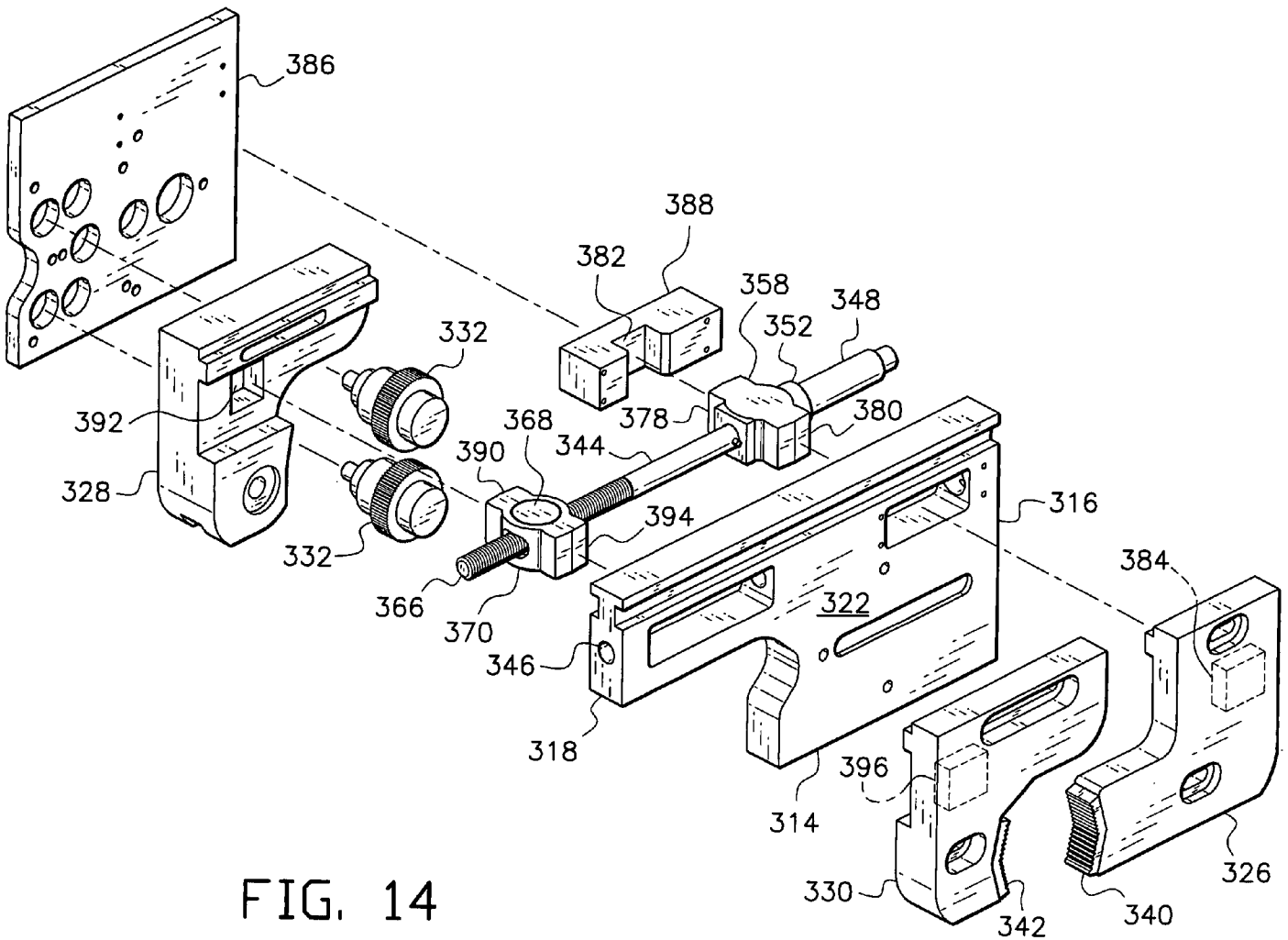
FIG. 14 is an exploded perspective view of the jaw assembly of the pipe wrench of FIG. 12, showing the placement of the jaw adjuster shaft assembly therein and other features.
Figure 15:
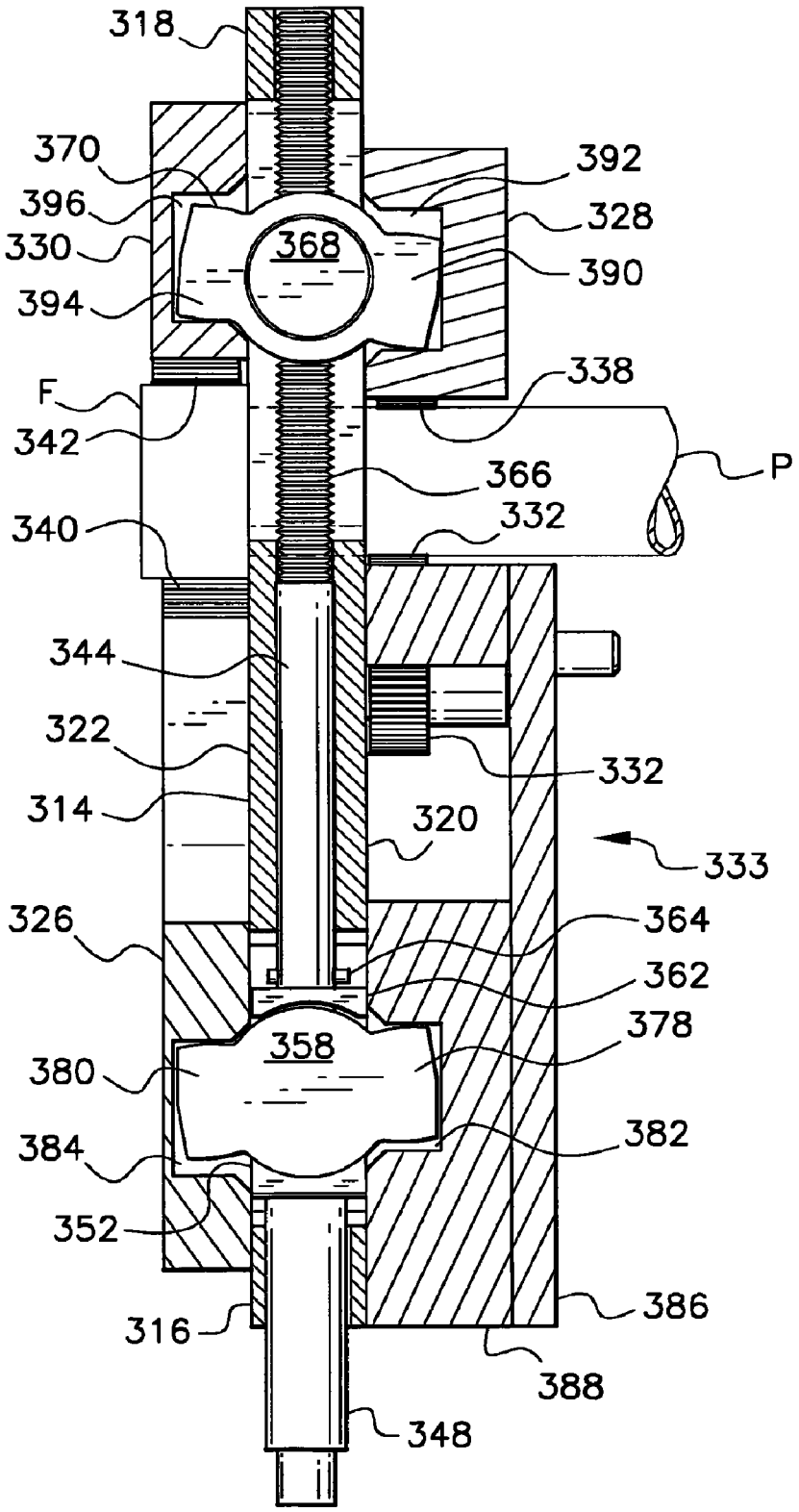
FIG. 15 is a top plan view in section of the jaw assembly of FIG. 14, showing the accommodation about different diameters of pipe components by the jaw adjuster assembly with its pivot blocks engaging the jaws.
Figure 16:
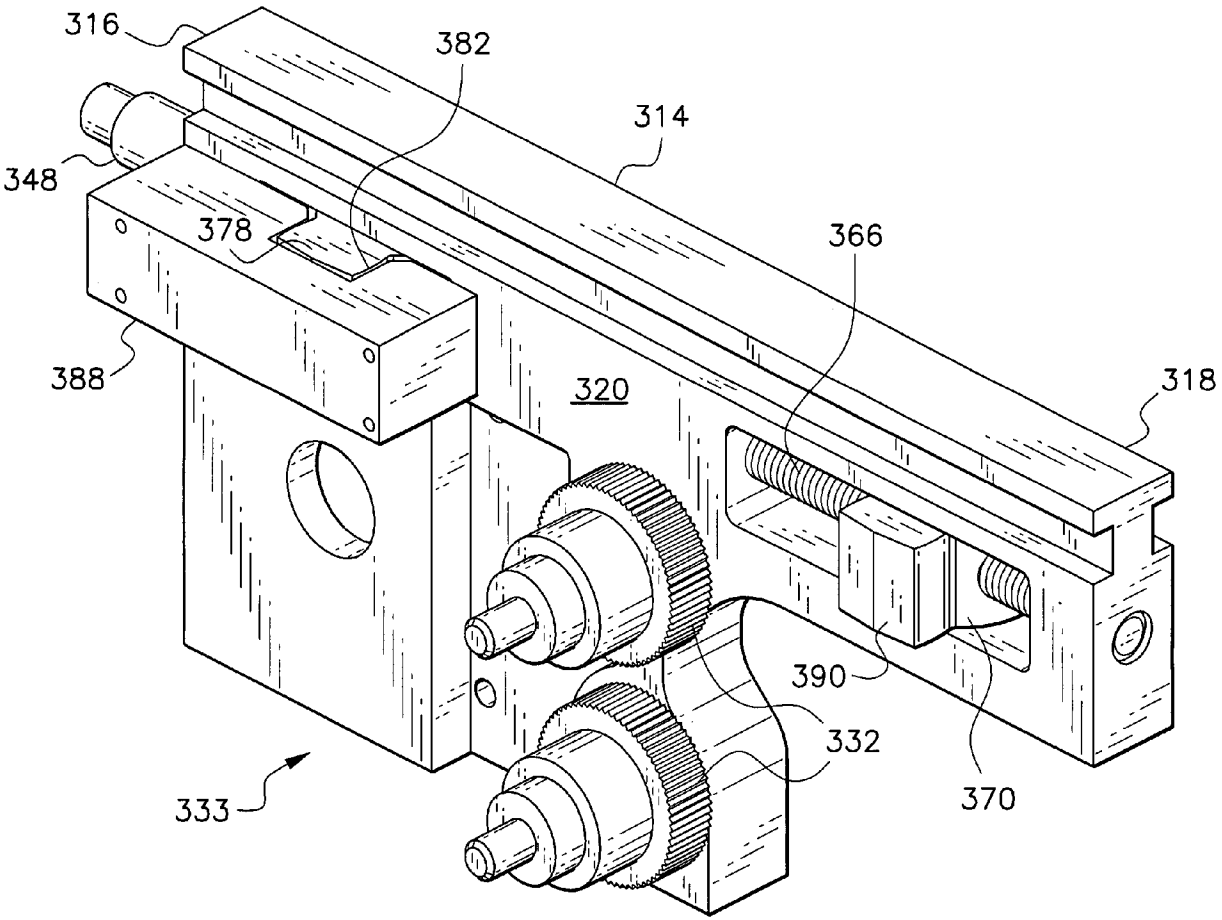
FIG. 16 is a right side perspective view of the jaw assembly of FIG. 14, shown with the speed reduction gear drive train removed to show the rotary pipe gripping wheels.

An elongate central jaw carrier 314, details of which may be seen in FIGS. 14 through 16, extends longitudinally from the motor housing 302 opposite the handle 308. The jaw carrier 314 includes a proximal motor housing attachment end or portion 316, and an opposite distal end or portion 318. The jaw carrier 314 has the general form of a thick plate of material, and has a roller side 320 and an opposite and parallel jaw side 322.

Figure 17:
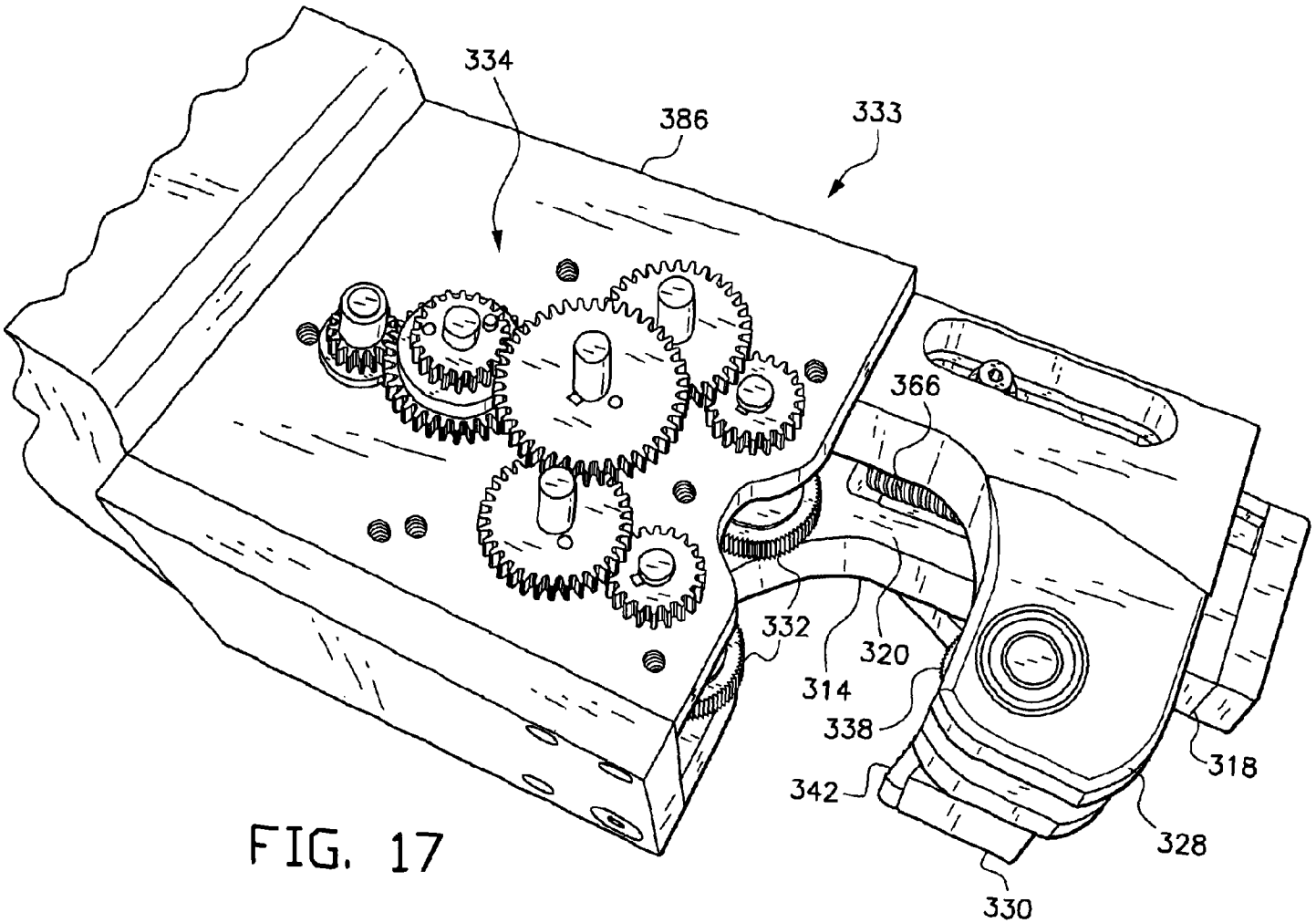
FIG. 17 is a right side perspective view of the jaw assembly of FIG. 16, showing the speed reduction gear drive train.

A transmission assembly 333 comprising a gear train 334, shown in FIG. 17, is enclosed by a cover or housing 336 (seen in FIG. 12) that is affixed to the roller side 320 of the central jaw carrier 314 along the motor housing end portion 316 thereof, with an opposite proximal jaw assembly 326 being slidably attached to the jaw side 322 of the jaw carrier 314 along the motor housing end portion 316 thereof, generally opposite the transmission assembly 333, the jaw carrier 314 being disposed therebetween. A roller wheel carriage 328 and a distal jaw assembly 330 are slidably installed upon opposite sides of the distal portion 318 of the jaw carrier 314. The proximal jaw assembly 326 and the distal jaw assembly 330 have some longitudinal adjustment relative to one another, as does the roller wheel carriage 328 and the stationary transmission assembly 333, to accommodate differences in the diameters of the components of the pipe assemblies being worked by the wrench 300.

The transmission assembly 333, comprising the gear train 334 (FIG. 17) and cover or housing 336, is immovably affixed to the first jaw side 320 of the central jaw carrier 314 and drives at least one, and preferably a pair of adjacent motorized, rotating gripping elements 332 therein that serve to rotate a pipe component relative to the wrench 300. The two gripping elements 332 are rollers driven by the gear train 334 (shown in FIG. 17, and substantially similar to the gear train 112 of the wrench 100 shown in FIGS. 8 through 11) protected by a housing or cover 336. The gear train 334, in turn, mechanically couples the motor 304 to the rotary gripping elements 332 by means of the worm gear and initial gear drive described further above.

The roller wheel carriage 328 includes a non-driven idler (follower) roller or gripping element 338 therein, the pipe component being gripped and rotated between the motor-driven gripping elements 332 and the non-driven idler roller 338. The powered rotary gripping elements 332 and the idler roller 338 are at least in substantially coplanar alignment with one another, as shown in the sectional top plan view of FIG. 15, in order to avoid bending moments on the pipe and wrench as the roller gripping elements 332 and 338 are tightened on the pipe. Each gripping element 332 and 338 may have a knurled surface or other surface having a high coefficient of friction to grip the pipe component and roll it between the wheels.

The proximal and distal jaw assemblies 326 and 330 do not include any rotary gripping components, but each has a fixed gripping element 340 and 342, respectively, therein. As the two gripping elements 340 and 342 do not permit rotation of an object gripped therebetween, a second pipe component, e.g., a pipe fitting, secured therein is held stationary relative to the wrench 300 even when the rotary grips 332 are actuated to rotate the first pipe component, e.g., length of pipe, to secure or separate the two pipe components to or from one another.

The roller wheel carriage 328 and the distal jaw assembly 330 are extended and retracted relative to the motorized gripping elements 332 and the proximal jaw assembly 326 by a partially threaded jaw adjuster shaft 344 that extends longitudinally through an axial passage 346, shown in FIG. 14, formed through the jaw carrier 314. The adjuster shaft 344 and components assembled thereon are shown in detail in FIGS. 13 and 14. The adjuster shaft 344 includes a relatively larger diameter proximal end portion 348 having a shoulder 350 against which a pivot block support collar 352 rests. The collar 352 has a dished face 354 that bears against the cooperatively shaped convex face 356 of a proximal pivot block 358. The passage 360 through the pivot block 358 has a laterally oval cross section, thereby allowing the pivot block 358 to pivot or rock laterally about an axis normal to the adjuster shaft 344 as the block 358 bears against the concave face 354 of its support collar 352, with the adjuster shaft 344 further being free to rotate axially relative to the pivot block 358. A proximal pivot block retainer 362 and pin 364 keep the proximal pivot block 358 in place on the adjuster shaft 344.

The distal portion 366 of the adjuster shaft 344 is threaded to accept a cooperatively threaded cylindrical pivot block insert 368 installed upon the distal portion of the shaft 344. The distal pivot block 370, in turn, has a cylindrical passage 372 therethrough, allowing the block 370 to pivot or rotate relative to the insert 368. The distal pivot block 370 includes laterally oval passages 374 therethrough, providing lateral clearance for lateral pivoting or rotation about the adjuster shaft 344. The adjuster shaft 344 is rotated by means of the adjuster knob 376, thereby advancing or retracting the threaded distal pivot block insert 368 and its distal pivot block 370 captured thereon.

Each of the pivot blocks 358 and 370 includes a pair of mutually opposed lateral extensions, with the proximal block 358 having first and second extensions 378 and 380. The transmission assembly 333, or more specifically, a stationary spacer block 388 affixed between the jaw carrier 314 and the gear train carrier plate 386, and the slidable proximal jaw assembly 326 have proximal pivot block receptacles defined therein, respectively including a first receptacle 382 in the spacer block 388 and a second receptacle 384 in the second proximal jaw assembly 326.

It will be noted that some space must be provided in the transmission assembly 333 to accommodate the thickness of the motorized gripping rollers 332 and the worm and primary gear drive (not shown) for the gear train 334. This is accomplished by forming the transmission assembly 333 of a relatively thin gear train carrier plate 386 and a spacer block 388, with the spacer block 388 actually having the first proximal jaw receptacle 382 formed therein. The space defined by the width or thickness of the spacer block 388 provides room for the worm and primary gear drive and for the two motorized gripping rollers 332 of the transmission assembly 333 between the thinner gear train carrier plate 386 and the roller side 320 of the central jaw carrier 314, with the remainder of the gear train 334 being installed on the outer side of the gear train carrier plate 386. FIG. 16 shows the roller side of the wrench assembly with the gear train carrier plate 386 removed therefrom, and FIG. 17 shows the gear train carrier plate 386 and gear train 334 installed.

The distal pivot block 370 engages the roller wheel carriage 328 and the distal jaw assembly 330 in a similar manner to that of the proximal block and jaw assembly. The distal pivot block 370 includes a first extension 390 that engages a mating first distal pivot block receptacle 392 in the slidable roller wheel carriage 328, and an opposite second extension 394 that engages a mating distal pivot block receptacle 396 in the distal jaw assembly 330. Each of the receptacles 382, 384, 392, and 396 is elongated to allow for the angular movement of its respective pivot block extension therein as the jaw assemblies are adjusted.

The top plan view in section of FIG. 15 provides an illustration of the operation of the powered adjustable pipe wrench 300. The wrench 300 is adapted for the assembly and disassembly of pipe and pipe fittings, e.g., a an externally threaded pipe to an internally threaded pipe fitting. It is well known that such pipe fittings, e.g., pipe caps, unions, elbows, tees, etc., have larger diameters than the pipe to which they connect. Moreover, the difference in diameters between a length of pipe and mating pipe fitting varies, depending upon the size of the pipe. Thus, when an adjustment is made to the jaws of a pipe wrench to fit a given pipe component, e.g., a length of pipe, that jaw adjustment will not fit the connecting pipe component of larger diameter, e.g., a pipe coupling, tee, etc.

The jaw adjustment made possible by the pivot blocks 358, 370 and their mating receptacles in the spacer block 388, the jaw assemblies 326 and 330, and the roller wheel carriage, which enable the jaw assemblies 326 and 330, the stationary gripping elements 332 in the transmission assembly, and the idler roller 338 in the roller wheel carriage 328 to adjust longitudinally relative to one another and to the jaw carrier 314 to accommodate such dimensional differences in pipe assemblies. For example, in FIG. 15 a length of pipe P is shown to be gripped by and extend from the roller side elements comprising motorized rollers 332 and freely rotating idler roller 338, with a larger diameter pipe fitting F being gripped by the laterally opposite second side fixed gripping elements 340 and 342. The jaws 326 and 330 are opened farther apart than the opposite first side rollers 332 and 338 due to the rollers 332 and 338 contacting the smaller diameter length of pipe P. When the slidable jaw assemblies 326 and 330 first contact the larger diameter fitting F as the adjuster knob 376 is tightened, those jaws stop their closure as their respective gripping elements 340 and 342 contact the larger diameter fitting F.

However, as the adjuster knob 376 is tightened further, the two pivot blocks 358 and 368 pivot about their positions on the adjuster shaft 344. More specifically, the second end 380 of the proximal pivot block 358 is held in place within the now locked in position proximal jaw assembly 326. The central portion of the proximal pivot block 358 is captured on the adjuster shaft 344. Thus, as the adjuster shaft 344 draws the two pivot blocks 358 and 370 closer together, the central portion of the proximal pivot block 358 urges the central carrier 314 to slide distally relative to the now fixed location proximal jaw assembly 326, thus also drawing the spacer block 388 and transmission assembly 333 with its powered rollers 332 toward the smaller diameter length of pipe P.

Simultaneously with the above action, the slidable roller wheel carriage 328 with its freely rotating idler roller 338 is drawn toward the powered rollers 332. This is due to the distal pivot block 370 being drawn proximally along the threaded portion 366 of the adjuster shaft 344. As the second end 394 of the distal pivot block 370 is now held in position by the second distal jaw assembly 330, it is forced to pivot about its pivot block insert 368. This forces the opposite first end 390 of the pivot block 370 toward the transmission assembly 333 and its powered rollers 332, thus sliding the roller wheel carriage 328 along the jaw carrier 314 toward the powered rollers 332 to capture the smaller diameter pipe length P between the roller assemblies 332 and 338.

In other words the extensions on one side of the two pivot blocks, i.e., second side extensions 380 and 394, are held in position in their respective jaw receptacles 384, 396 as the tightening of the adjuster knob 376 and rotation of the adjuster shaft 344 draws the two pivot blocks 358 and 368 closer to one another. This draws the roller side pivot block extensions 378 and 390 closer together as the two pivot blocks 358 and 368 pivot on the adjuster shaft 344, thereby urging the roller wheel carriage 328 closer to the spacer block 388 and its affixed components, including the powered rollers 332, so that their respective gripping rollers 338 and 332 grip the smaller diameter pipe P. Accordingly, the powered adjustable pipe wrench 300 greatly facilitates the assembly and disassembly of pipes and pipefittings of various diameters, without the need for additional tool accessories, wrenches, and other components.

It is to be understood that the present invention is not limited to the embodiments described above, but encompasses any and all embodiments within the scope of the following claims.

I claim:

1. A powered adjustable pipe wrench, comprising:

a motor housing;

a central jaw carrier extending longitudinally from the motor housing, the jaw carrier having a proximal housing attachment portion, a distal portion opposite therefrom, a roller side, and a jaw side opposite the roller side;

a proximally disposed transmission assembly affixed to the roller side of the jaw carrier;

a proximal jaw assembly extending from the jaw side of the jaw carrier, the jaw assembly and the transmission assembly being disposed on opposite sides of the jaw carrier, the proximal jaw assembly being slidable and longitudinally adjustable relative to the jaw carrier;

a roller wheel carriage and a distal jaw assembly slidably disposed on opposite sides of the distal portion of the jaw carrier;

at least one motorized, rotating gripping element selectively driven by the transmission assembly;

a free wheeling, rotating idler roller gripping element disposed on the roller wheel carriage; and a fixed gripping element immovably affixed within the proximal and distal jaw assemblies;

wherein the motorized and free wheeling gripping elements are adapted for gripping and rotating a first pipe component when the proximal and distal jaw assemblies are adjusted towards each other; and wherein the jaw assemblies are adapted for holding a second pipe component stationary relative thereto when the motorized gripping elements are rotated in order to engage and disengage the first and second pipe components.

2. The powered adjustable pipe wrench according to claim 1, further comprising a jaw adjuster shaft disposed longitudinally through the jaw carrier, the shaft adjustably engaging the proximal jaw assembly and distal jaw assemblies, and the roller wheel carriage.

3. The powered adjustable pipe wrench according to claim 2, wherein the transmission assembly and the proximal jaw assembly each having a proximal pivot block receptacle defined therein and the roller wheel carriage and the distal jaw assembly each have distal pivot block assemblies defined therein. The pipe wrench further comprising a proximal pivot block and a distal pivot block pivotally disposed within the jaw carrier, the distal pivot block being threadably engaged upon the jaw adjuster shaft, the proximal pivot block adjustably engaging the proximal pivot block receptacles and the distal pivot block adjustably engaging the distal pivot block assemblies to adjust the jaw assemblies and gripping elements longitudinally relative to one another.

4. The powered adjustable pipe wrench according to claim 1, further comprising a motor disposed in the motor housing; and a switch electrically connected to the motor, the switch being movable between a first position in which the at least one rotating gripping element of the transmission assembly remains stationary and a second position in which the motor drives the at least one rotating gripping element to rotate.

5. The powered adjustable pipe wrench according to claim 4, further comprising a gear train coupling the motor to the at least one rotating gripping element of the transmission assembly.

6. The powered adjustable pipe wrench according to claim 4, wherein the motor comprises a reversible electric motor.

7. The powered adjustable pipe wrench according to claim 4, wherein the motor is a pneumatically powered motor.

8. The powered adjustable pipe wrench according to claim 4, wherein the motor is a hydraulically powered motor.

9. The powered adjustable pipe wrench according to claim 1, wherein the at least one gripping element of the transmission assembly comprises first and second adjacent rollers extending from the transmission assembly.

10. The powered adjustable pipe wrench according to claim 9, wherein the first and second rollers of the transmission assembly and the free wheeling, rotating idler roller gripping element are substantially coplanar.

11. A powered adjustable pipe wrench, comprising:

a motor housing;

a central jaw carrier extending longitudinally from the motor housing, the jaw carrier having a proximal housing attachment portion, a distal portion opposite therefrom, a roller side, and a jaw side opposite the roller side;

a proximally disposed transmission assembly affixed to the roller side of the jaw carrier;

a proximal jaw assembly extending from the jaw side of the jaw carrier, the proximal jaw assembly and the transmission assembly being disposed on opposite sides of the jaw carrier, the proximal jaw assembly being longitudinally adjustable relative to the jaw carrier, the transmission assembly and the proximal jaw assembly each having a proximal pivot block receptacle defined therein;

a roller wheel carriage and a distal jaw assembly disposed on opposite sides of the distal portion of the jaw carrier, the distal jaw assembly being longitudinally adjustable relative to the proximal jaw assembly, the roller wheel carriage being longitudinally adjustable relative to the transmission assembly;

a jaw adjuster shaft disposed longitudinally through the jaw carrier and adjustably engaging the proximal jaw assembly, the distal jaw assembly, and the roller wheel carriage;

a proximal pivot block pivotally disposed within the jaw carrier, the proximal pivot block adjustably engaging the receptacles of the transmission assembly and proximal jaw assembly; and a distal pivot block pivotally disposed within the jaw carrier, the distal pivot block being threadably engaged upon the jaw adjuster shaft, the distal pivot block adjustably engaging the receptacles of the distal jaw assembly and the roller wheel carriage.

12. The powered adjustable pipe wrench according to claim 11, further comprising:

at least one motorized, rotating gripping element selectively driven by the transmission assembly;

a free wheeling, rotating idler roller gripping element disposed on the roller wheel carriage; and a fixed gripping element immovably affixed within each of the second proximal and second distal jaw assemblies;

wherein the proximal and distal jaw assemblies are adapted for gripping and holding a pipe fitting stationary while the motorized gripping elements and the idler roller rotate a threaded pipe component therebetween in order to thread the pipe to or unthread the pipe from the pipe fitting.

13. The powered adjustable pipe wrench according to claim 11, further comprising a motor disposed in the motor housing; and a switch electrically connected to the motor, the switch being movable between a first position in which the at least one rotating gripping element of the transmission assembly remains stationary and a second position in which the motor drives the at least one rotating gripping element to rotate.

14. The powered adjustable pipe wrench according to claim 13, further comprising a gear train coupling the motor to the at least one rotating gripping element of the transmission assembly.

15. The powered adjustable pipe wrench according to claim 13, wherein the motor comprises a reversible electric motor.

16. The powered adjustable pipe wrench according to claim 13, wherein the motor is a pneumatically powered motor.

17. The powered adjustable pipe wrench according to claim 13, wherein the motor is a hydraulically powered motor.

18. The powered adjustable pipe wrench according to claim 11, wherein the at least one gripping element of the transmission assembly comprises first and second adjacent rollers extending from the transmission assembly.

19. The powered adjustable pipe wrench according to claim 18, wherein the first and second rollers of the transmission assembly and the free wheeling, rotating idler roller gripping element are substantially coplanar.

* * * * *